US010508404B2

(12) United States Patent
DeWind et al.

(10) Patent No.: US 10,508,404 B2
(45) Date of Patent: Dec. 17, 2019

(54) BARRIER WALL AND METHOD AND SYSTEM OF MAKING A BARRIER WALL

(71) Applicant: DeWind One-Pass Trenching, LLC, Zeeland, MI (US)

(72) Inventors: Gregory Allen DeWind, Zeeland, MI (US); Ryan DeWind, Zeeland, MI (US)

(73) Assignee: DeWind One-Pass Trenching, LLC, Zeeland, MI (US)

( * ) Notice: Subject to any disclaimer, the term of this patent is extended or adjusted under 35 U.S.C. 154(b) by 0 days.

(21) Appl. No.: 15/824,171

(22) Filed: Nov. 28, 2017

(65) Prior Publication Data

US 2019/0161935 A1 May 30, 2019

(51) Int. Cl.
*E02D 29/05* (2006.01)

(52) U.S. Cl.
CPC ..... *E02D 29/05* (2013.01)

(58) Field of Classification Search
CPC . E04B 2/8658; E04B 2/26; E04B 2/18; E02D 29/05; E02D 29/0266; E02D 29/0275; E02D 29/0283; E02D 29/045
See application file for complete search history.

(56) References Cited

U.S. PATENT DOCUMENTS 2,205,730 A * 6/1940 Morgan ..... E04B 2/18 220/4.28
3,180,060 A * 4/1965 Persak, Jr. ..... E04B 2/18 52/307
4,098,042 A * 7/1978 Sachs ..... E04B 1/165 52/383
2009/0191003 A1* 7/2009 Kruse ..... E02D 17/04 405/229
2014/0308079 A1* 10/2014 Hamrick ..... E04C 2/06 405/153

FOREIGN PATENT DOCUMENTS

WO WO-2007131387 A1 * 11/2007 ..... E04B 1/0023

* cited by examiner

*Primary Examiner* — Christine T Cajilig
(74) *Attorney, Agent, or Firm* — The Watson IP Group, PLC; Jovan N. Jovanovic

(57) ABSTRACT

A barrier wall configured for formation and placement within a formed trench. The barrier wall is formed from a plurality of wall segments. Each wall segment comprises a wall body, a length coupling subassembly and a width coupling subassembly. The wall body includes a front surface and a back surface. The length coupling subassembly is coupled to the wall body. The width coupling subassembly coupled to the wall body. The plurality of wall segments can be attached to each other by joining at least one of the length coupling subassembly of one of the plurality of wall segments to another one of the plurality of wall segments, and the width coupling subassembly of one of the plurality of wall segments to another one of the plurality of wall segments.

6 Claims, 9 Drawing Sheets

BARRIER WALL AND METHOD AND SYSTEM OF MAKING A BARRIER WALL

CROSS-REFERENCE TO RELATED APPLICATION

N/A

BACKGROUND OF THE DISCLOSURE

1. Field of the Disclosure

The disclosure relates in general to the building of barriers, and more particularly, to a barrier wall and a method and system of making a barrier wall.

2. Background Art

The need to form walls underground are known in the art. In many instances it is desirable to form a wall underground for purposes of containment or protection. For example, it has become common to utilize tunnels and to form tunnels as a form of escape route or a route for the passage of goods and people between locations. In many instances, where surface surveillance is present, these tunnels are utilized to circumvent the surveillance.

Problematically, even where devices have been installed to sense the digging of tunnels, or where blockades have been placed into the ground, they have been insufficient. In many instances, the tunnels can be formed at sufficient depth to avoid triggering sensors, and below existing barriers and blockades that tend to be quite shallow.

Some barrier walls have been formed that are quite deep. To form these structures, a trench is first formed, and filled with a slurry to prevent collapsing of the trench. Next, concrete is poured into the trench to displace the slurry. The concrete is then allowed to harden to form the wall. Such a procedure is very time consuming, as much activity and time is required to pour and form the concrete. In many instances it is necessary to create forms and to insert reinforcement rods and the like into the slurry to aid in strengthening the otherwise concrete wall. In addition, it is difficult to know the exact structure of the trench as portions of the trench walls may collapse, portions of the trench may cave in during formation, or portions of the slurry may become trapped within the poured concrete.

As a result of these issues, there may be portions of the wall that are varying strength. There are additionally portions of the wall that may be completely missing or which may be formed primarily from trapped slurry, or dirt from a partially collapsed trench. Finally, it is difficult to provide sensors which can be inserted and removed from the trench; rather, sensors generally become encased within the hardened concrete for their useful lifetime. It is virtually impossible to replace or insert new sensors.

SUMMARY OF THE DISCLOSURE

The disclosure is directed, in one aspect to a barrier wall that is configured for formation and placement within a formed trench. The barrier wall is formed from a plurality of wall segments. Each wall segment comprises a wall body, a length coupling subassembly and a width coupling subassembly. The wall body includes a front surface and a back surface. The length coupling subassembly is coupled to the wall body. The width coupling subassembly coupled to the wall body. The plurality of wall segments can be attached to each other by joining at least one of the length coupling subassembly of one of the plurality of wall segments to another one of the plurality of wall segments, and the width coupling subassembly of one of the plurality of wall segments to another one of the plurality of wall segments.

In some configuration, the wall body further comprises an outer frame with a filler positioned therewithin.

In some configurations, the outer frame further includes a top surface, a bottom surface opposite the top surface, a tab side surface extending between the top surface and the bottom surface and a slot side surface extending between the top surface and the bottom surface opposite the tab side surface, to, in turn, define a rectangular cubic configuration. In some configurations, the filler comprises a concrete material.

In some configurations, the wall segment further includes a plurality of inner braces embedded within the filler, to, reinforce the same.

In some configurations, the wall segment further comprises a communication structure extending between the top surface and the bottom surface.

In some configurations, the communication structure further comprises a plurality of elongated tubes extending between the top surface and the bottom surface.

In some configurations, the communication structure further includes a manifold coupling a first end of a plurality of the plurality of elongated tubes, and an inlet providing ingress into the manifold.

In some configurations, the length coupling subassembly further comprises an upper coupling associated with the top surface and a lower coupling associated with the bottom surface.

In some configurations, the upper coupling comprises at least one of a protrusion and a channel and the lower coupling comprises at least one of the other of a protrusion and a channel, with the upper coupling and the lower coupling structurally configured to be positionable in engagement.

In some configurations, the upper coupling comprises a first protrusion and a second protrusion each having an inner locking structure. The lower coupling comprises a first channel and a second channel each having an outer locking structure. A locking pin can be interfaced between the inner locking structure and the outer locking structure of each of the lower and upper couplings positionable in engagement.

In some configurations, the width coupling subassembly further comprises a first side width coupling member and a second side width coupling member. The first width coupling member extending along the slot side surface. The second width coupling member extending along the tab side surface.

In some configurations, the first side width coupling member comprises a slot and the second side width coupling member comprises a tab. The tab is slidably insertable within the slot.

In some configurations, the tab is configured to be pivotable within the slot.

In some configurations, the wall segment further comprises at least one receiving opening extending transversely through the wall body from the front surface to the back surface proximate an top end thereof, structurally configured to receive a position retaining member therein.

In another aspect of the disclosure, the disclosure is directed to a method of forming a wall comprising the steps of: forming a trench having a first end, a second end, a first side and a second side; precluding the caving in of the trench; inserting a first wall segment into the trench; maintaining an inserted position of the first wall segment; providing a second wall segment; coupling the second wall segment to the first wall segment; inserting the second wall segment into the trench to form a barrier wall.

In some configurations, the method further comprises the steps of: providing an additional wall segment; coupling the additional wall segment to the barrier wall; inserting the additional wall segment into the trench; and repeating the steps of providing and coupling and inserting for each desired wall segment.

In some configurations, the wall segment comprises a rectangular cubic configuration with a length coupling subassembly and a width coupling subassembly. The method further comprising the steps of: utilizing the length coupling assembly and the width coupling assembly to form a barrier wall that is both longer and wider than a wall segment.

In some configurations, the method further comprise the step of: placing at least one sensor within the barrier wall.

In yet another aspect of the disclosure, the disclosure is directed to a wall segment for the formation of a barrier wall configured for formation and placement within a formed trench. The wall segment comprises a wall body, a length coupling subassembly and a width coupling assembly. The wall body includes a front surface and a back surface. The length coupling subassembly is coupled to the wall body. The a width coupling subassembly is coupled to the wall body.

BRIEF DESCRIPTION OF THE DRAWINGS

The disclosure will now be described with reference to the drawings wherein.

DETAILED DESCRIPTION OF THE DISCLOSURE

Figure 1:
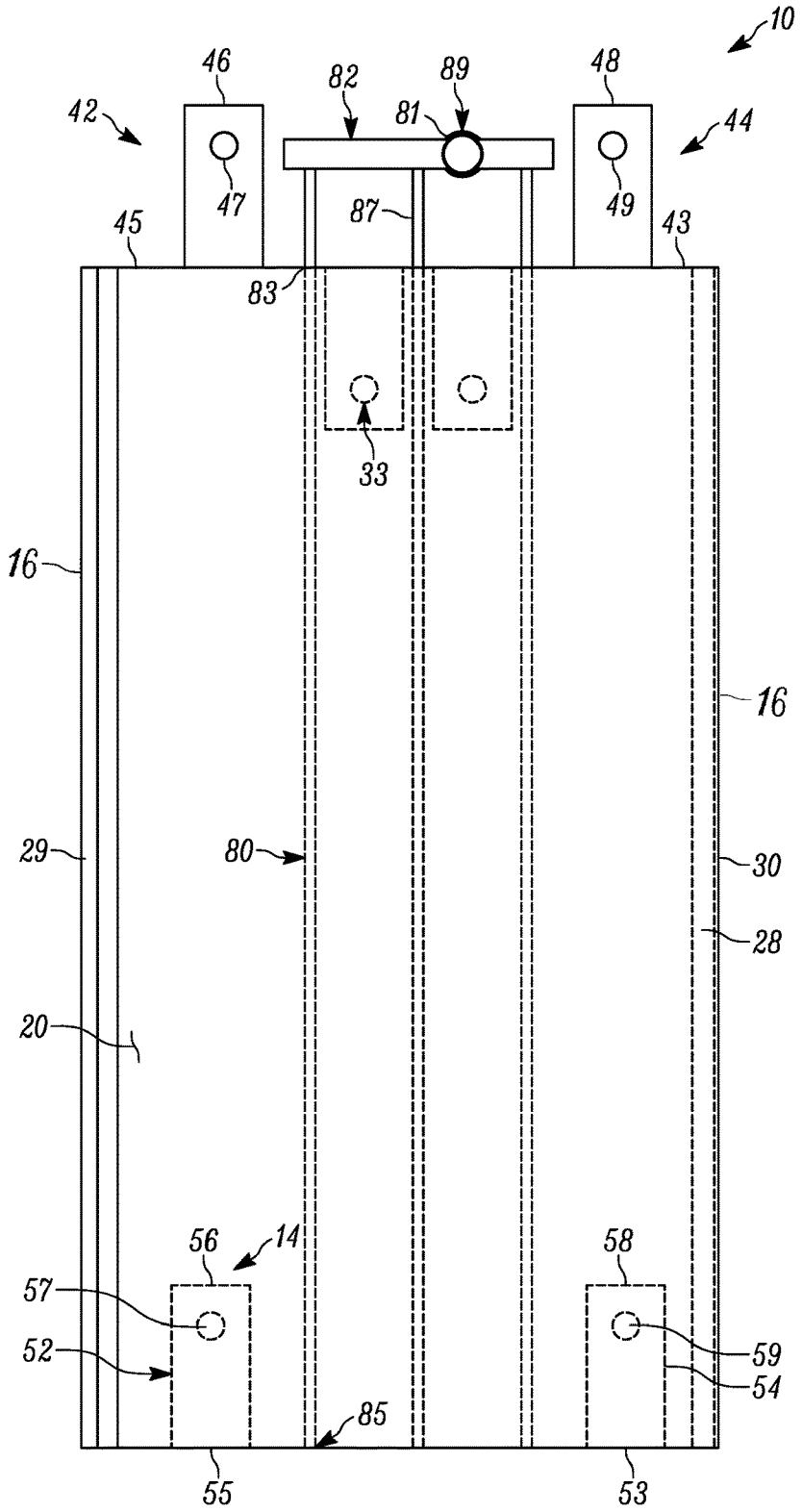
FIG. 1 of the drawings is a front plan view of a wall segment showing, in particular, the elongated tubes and the length coupling structures therewithin.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIGS. 1 through 4, a wall segment 10 is shown. The wall segment 10 includes wall body 12, length coupling subassembly 14, width coupling subassembly 16, and communication structure 18. It will be understood that a plurality of wall segments can be coupled together in both columns and rows to form a barrier wall that can be buried within a trench in the ground. The wall body 12 of the wall segment 10 is the support structure for the barrier wall 100 and assembled in such a way to allow tight connections between subsequent wall segments 10. The length coupling subassembly 14 is situated on the top surface 24 and bottom surface 26 of the wall body 12, with the width coupling subassembly 16 situated on tab side surface 28 and slot side surface 29 of the wall body 12. Communication structures 18 exist within the wall segment 10 through the top surface 24 insofar as to allow communication, sensory and other applicable devices to be inserted into the wall segment 10.

As it will be understood, a plurality of wall segments 10 are designed to be coupled together and to sit inside a trench 120 of variable length and width. The wall segment 10 has fixed dimensions dependent upon the length, width, and depth of the wall body 12. Differing dimensions of wall segment 10 may be constructed by altering the length, width, and depth of the outer frame 30. The barrier wall 100 is assembled using the length coupling subassembly 14 between subsequent wall segments 10 to increase the height and the width coupling subassembly 16 between subsequent wall segments 10 to increase the barrier wall 100 width to a variable length. It is to be understood, to reduce the amount of power and machinery necessary to have the wall segments 10 assembled, the length coupling subassemblies 14 will be assembled before the width coupling subassemblies 16 within the trench cavity 129. This assembly method reduces the amount of power necessary to support the barrier wall 100 during assembly by holding the minimal number of wall segments 10 at any one time. Of course, other constructions are likewise contemplated. That is, the different wall segments can be coupled together in alternative fashions, or may be pre-assembled in part or in whole prior to insertion into the trench.

Figure 2:
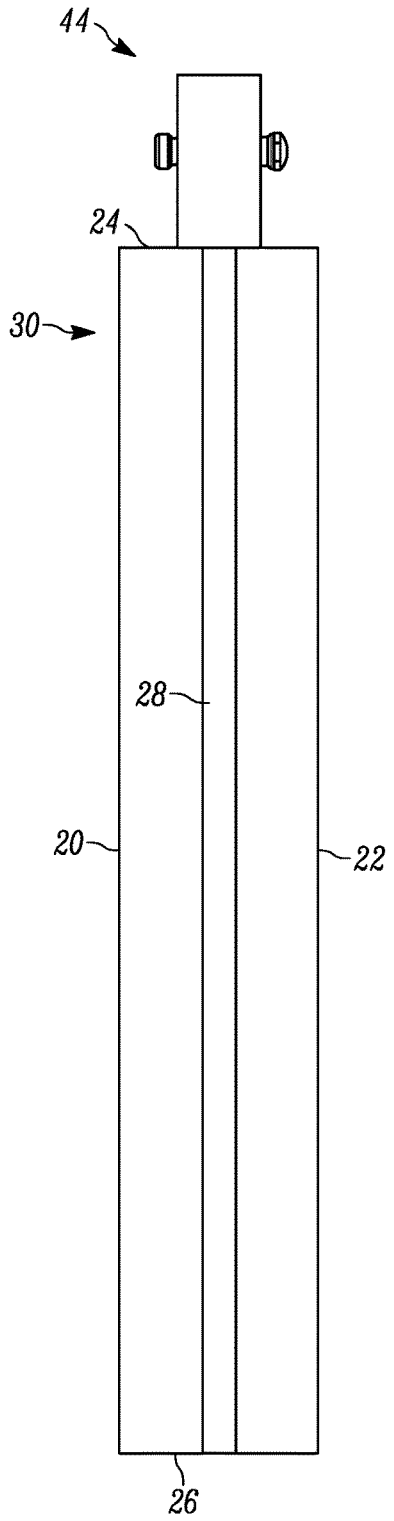
FIG. 2 of the drawings is a tab side elevational view on the wall segment, showing, in particular, the width coupling assembly, and more particularly, the first side width coupling member thereof.
Figure 3:
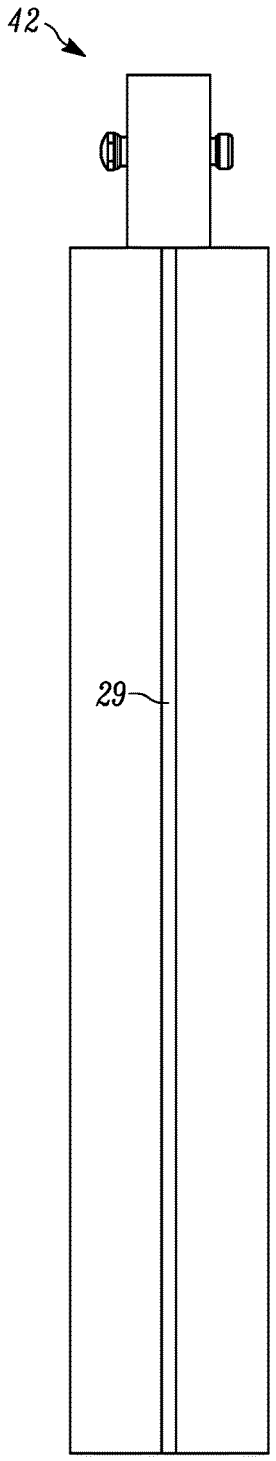
FIG. 3 of the drawings is a slot side elevational view on the wall segment, showing, in particular, the width coupling assembly, and more particularly, the second side width coupling member thereof.
Figure 4:
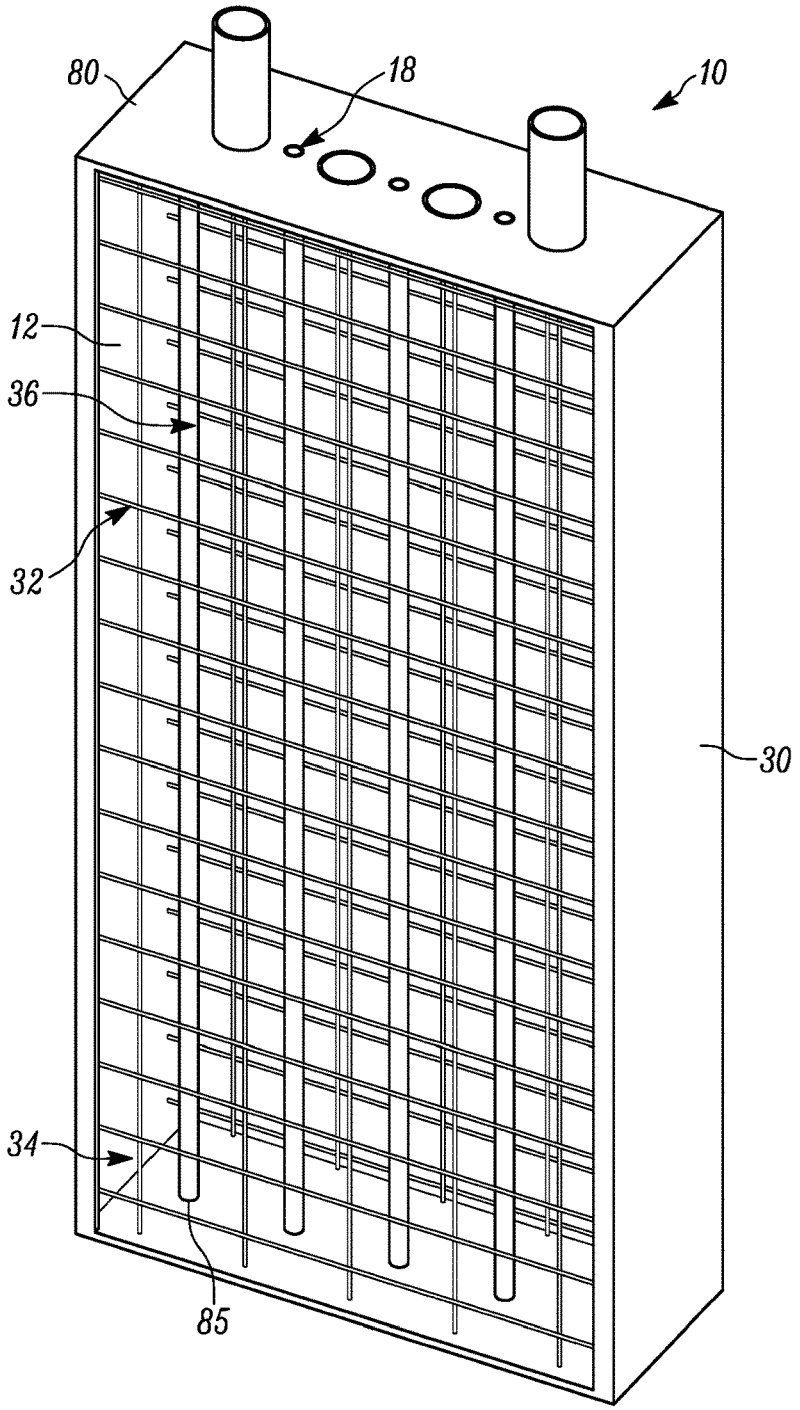
FIG. 4 of the drawings is a perspective view of the wall segment with the cavity material removed to show the inner portions of the wall segment.

As shown in FIGS. 2-4, the wall body 12 includes a front surface 20, back surface 22, top surface 24, bottom surface 26, tab side surface 28, slot side surface 29, outer frame 30, inner braces 32, receiving openings 33, filler 34, and cavity 36. The front surface 20 and back surface 22 are, in the configuration shown, are generally equal and opposite, aligned so as to be parallel to one another. The tab side surface 28 and slot side surface 29 are, in the configuration shown, generally opposite and generally complementarily parallel to one another. The top surface 24 and bottom surface 26 are, in the configuration shown, generally equal and opposite one another, and generally complementarily parallel to one another.

The outer frame 30 is the outer support structure for the wall body 12. It is assembled through welding of metal frames, in the configuration shown. The outer frame 30 has matched dimensions to the wall body 12 due to its presence along all connecting surface edges and walls. For example, the superior portion of the outer frame 30 is along the outer edges of the top surface 24 where the top surface 24 connects to the front surface 20, back surface 22, tab side surface 28, and slot side surface 29. The inner braces 32 of the wall body 12 are connected to the outer frame 30 within the cavity 36 of the wall body 12. The cavity 36 is defined as the space within the outer frame 30, which includes the inner braces 32 and will be filled with, in the configuration shown, a concrete filler 34. The inner braces 32 comprise reinforcement in the form of rebar that is welded to the outer frame. The inner braces 32 are metallic in nature and exist to provide support the outer frame 30 from forces by increasing the number of contact points within the frame, and also to provide reinforcement to the concrete.

It is contemplated that the wall segments are rectangular configurations having a length between 10 and 60 feet and a width between two and eight feet. It is further contemplated that the depth of the wall segments may be between six inches and two feet, although variations are contemplated. Of course, the dimensions of certain wall segments may be larger or smaller than these dimensions. Additionally, it is contemplated that other shapes, other than rectangular shapes are contemplated. That is, other parallelogram configurations are contemplated, as well as other polygonal structures (i.e., octagons, hexagons, or the like). Further still, it is contemplated that multiple differently shaped barrier walls can be utilized. In one configuration, the geometric shapes may be different. In other configurations, the shapes may be the same, but dimensionally, the wall segments may be different.

The receiving openings 33 of the wall body 12 are located on the front surface 20 and back surface 22 and extend therethrough. The receiving openings 33, in the configuration shown, are cylindrical in nature and extend outwardly generally parallel between the tab side surface 28 and slot side surface 29. Of course, other configurations, other than cylindrical are contemplated, as are orientations that are not parallel to each other. The receiving openings 33 are utilized for securing the position restraining members 130 during assembly of the barrier wall.

As will be explained below, filler 34, which may comprise a concrete is poured into the cavity 36 following the full assembly of the outer frame 30, inner braces 32, and receiving openings 33, as well as the portions of the length coupling subassemblies. The filler 34 is a concrete pour material that will be bound by the outer frame 30

Figure 7:
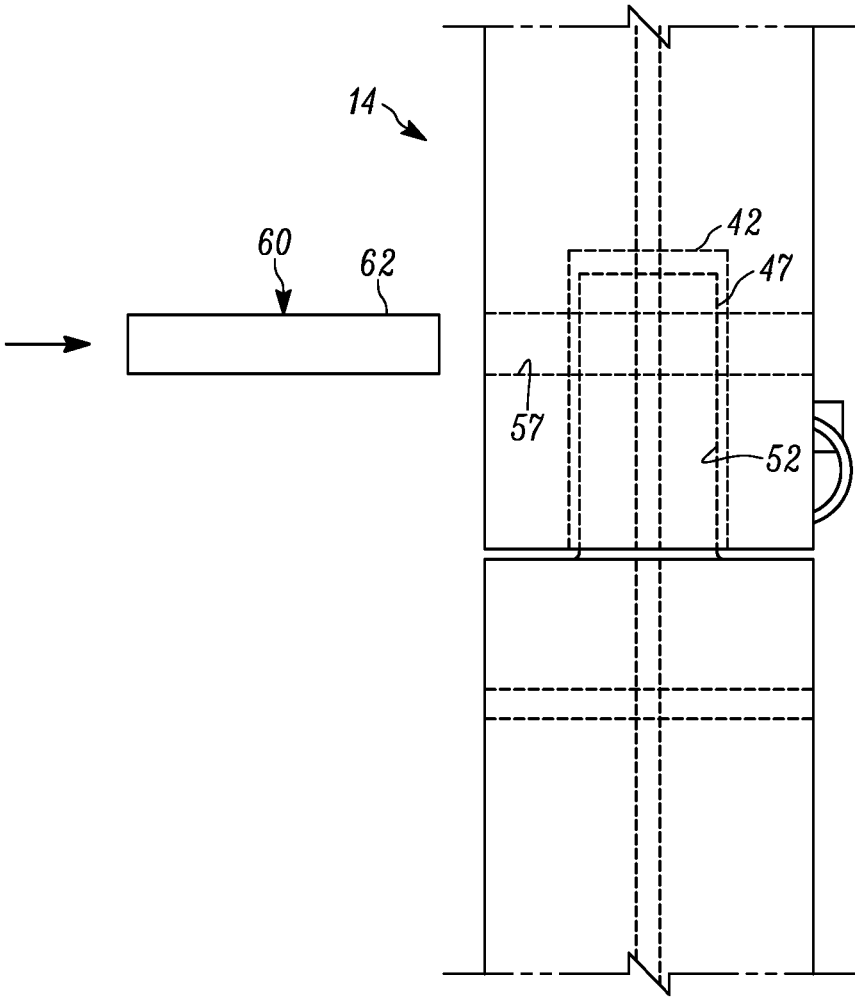
FIG. 7 of the drawings is a partial side elevational view of two walls segments coupled together through the upper and lower coupling members of the length coupling subassembly, with locking pins.

As illustrated in FIGS. 1 and 7, the length coupling subassembly 14 comprises upper coupling 40, lower coupling 50, first locking pin 60, and second locking pin 62. The upper coupling 40 comprises first protrusion 42 and second protrusion 44, both extending outwardly from the wall body 12. The first protrusion 42 comprises a proximal end 45, distal end 46, and first inner locking structure 47. The second protrusion 44 comprises a proximal end 43, distal end 48, and second inner locking structure 49. The proximal end of each of the protrusions is proximate the top surface 24 with the distal end 46 and distal end 48 extending outwardly from the top surface 24. The first inner locking structure 47 comprises an opening that is generally perpendicular to the protrusion and, in the configuration shown, perpendicular to the top surface. The opening is spaced apart from each of the proximal end and the distal end of the protrusion. Similarly, the second inner locking structure 49 comprises an opening that is generally perpendicular to the protrusion and, in the configuration shown, perpendicular to the top surface. The opening is likewise spaced apart from each of the proximal end and the distal end of the protrusion. These openings are configured to receive a first locking pin and a second locking pin 60, 62, respectively, as will be described below.

The lower coupling 50 comprises first channel 52 and second channel 54, both extending internally into the wall body 12 inwardly from the bottom surface 26 of the wall body 12. The first channel 52 has proximal end 55, distal end 56, and first outer locking structure 57. The second channel 54 has proximal end 53, distal end 58, and second outer locking structure 59. The distal end 56 and distal end 58 are situated internally to the wall body 12 within the filler 34. The proximal end 55 and proximal end 53 are proximate the bottom surface 26 of the wall body 12. The first outer locking structure 57 and second outer locking structure 59 are openings extending through the front surface 20 of the wall body 10 and back surface 22, and through the first channel 52 and second channel 54, respectively. The first outer locking structure 57 and second outer locking structure 59 are generally perpendicular to the first channel 52 and second channel 54, and are positioned between the proximal and distal ends and generally correspond to the corresponding one of the openings of the upper coupling It will be understood that the upper and lower couplings may comprise either protrusions or channels, or each one of a protrusion and a channel. For example, the upper coupling may include channels, with the lower coupling including protrusions. In other configurations, the upper coupling may include channel(s) and protrusion(s), with the lower coupling including the same.

Figure 6:
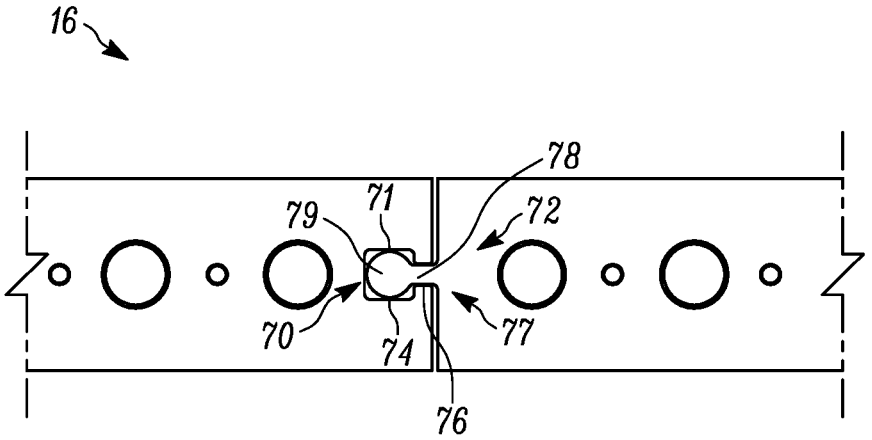
FIG. 6 of the drawings is a partial top plan view of two wall segments coupled together through their respective width coupling subassemblies.

As shown in FIGS. 2, 3, and 6, the width coupling subassembly 16 comprises first side width coupling member 70 and second side width coupling member 71. The first side width coupling member 70 is defined by a slot structure 72 that includes inner slot portion 74 and entry slot channel portion 76. Additionally, the second side width coupling member 71 is defined by tab structure 77 that is further defined by neck portion 78 and outer tab body portion 79. The first side width coupling member 70 and second side width coupling member 72 are opposite structures on the wall body 12 extending along the length of the slot side surface 29 and tab side surface 28, respectively. In the configuration shown, the first and second side coupling members extend along the length of the respective side wall. In the configuration shown, the side coupling members extend along the entirety of the length of the side walls, while other configurations are contemplated. Additionally, in the configuration shown, the two slot structures are generally parallel to each of the front and back surfaces of the wall body and are generally positioned in a spaced apart relation to each of the front and back wall. Of course, other configurations are contemplated.

In relation, the slot structure 72 has inner slot portion 74 that has width and depth greater than or equal to the outer tab body portion 79 of the tab structure 77. Further, the inner slot portion 74 of slot structure 72 is of equal length or greater than the neck portion 78 of the tab structure 77. The depth of the outer tab body portion 79 is greater than the allowable depth of the entry slot channel portion 76, creating a locking mechanism between the first side width coupling member 70 and second side width coupling member 71. This allows the tab structure 77 to slide into the slot structure 72 and create a mate of the slot side surface 29 and tab side surface 30 of two separate and laterally positioned wall segments 10. Positioning in this assembly results in the front surface 20 of the adjacent wall segments to be in plane in relation to one another. It will be understood that the structures may have some spacing such that adjacent wall segments are able to pivot relative to each other, generally about an axis that is disposed within the side with coupling member.

Figure 5:
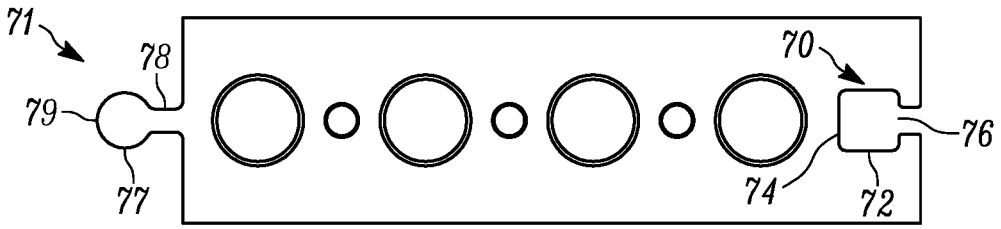
FIG. 5 of the drawings is a top plan view of the single wall showing the width and length coupling members.

As shown in FIGS. 4 and 5, the communication structure 18 comprises a plurality of elongated tubes, such as elongated tube 80 and manifold 82. The elongated tubes each generally include a first end 83 and a second end 84, with the first end being positioned proximate top surface 24 and the second end being positioned proximate the bottom surface 26. The manifold includes tube coupling member 87 and inlet member 89. Manifold 82 has tube coupling members 87 that attach to the elongated tubes 80 in a way that generally places the tubes into fluid communication with the manifold. Inlet member 89 of manifold 82 provides ingress and egress into and out of the manifold. A cap 81 may be positioned and secured to the inlet member 89. The cap 81 may be secured in a manner that prevents the flow of water-like or other liquid materials through the inlet member 89, such as through a fastener or the like. It will be understood, and explained below, that a fluid source, such as a hose or the like can also be coupled to the inlet member 89 of the manifold. While three elongated tubes are shown, it is contemplated that a greater or lesser amount of tubes may be provided. Additionally, it is contemplated that the tubes may be of varying size and shape, while in the configuration shown, each of the tubes comprises a member of circular cross-sectional configuration. Additionally, the diameter of such tubes may be larger or smaller than that which is shown.

To form a wall segment, an outer frame 30 is constructed. Appropriately sized metal beams are coupled together (for example, through fasteners or welding) in relation to one another to match the desired lengths, widths, and depths of the desired wall segment 10. It will be understood that the appropriate openings and the like are provided on the top panel and the bottom panel for the structures of the width coupling subassembly 18 and the elongated tubes 80.

Once the frame is formed, the first and second protrusions 42 can be coupled to the frame, and in particular the top panel thereof. In some instances a portion of the protrusion extends into the cavity 36.

The inner braces 32 are placed inside following the welding of the outer frame 30 and joined, again through welding or the like to the outer frame.

Next, the forms for the receiving openings are positioned and maintained in the proper position through jigs, or through coupling to one of the outer frame 30 and the inner braces 32. Similarly, the forms for the first and second channel of the lower coupling 50 can be positioned within the cavity and coupled, through welding or the like, to the bottom surface of the outer frame.

Further, the slot structure 72 on the slot side surface 29 and tab structure 77 on the tab side surface 38 are joined to the outer frame 30. The slot structure 72 and tab structure 77 can be prefabricated before securing to the outer frame 30. While it is contemplated that the structures may be welded together, other methods of joining, including, but not limited to securement with fasteners and the like is contemplated.

Once all of the components that are at least partially positioned within the cavity 36 are positioned and secured, the cavity 36 is filled with a concrete material filler 34. The filler 34 is configured to fill the cavity 36 of the wall segment 10 and to form much of the structure of the wall body. Such a concrete material is generally difficult to breach and can be poured and created relatively quickly and easily. It is contemplated that in other configurations, in place of the concrete material fill, other materials may be utilized, such as, for example, metal plates that form the top and bottom surface, with a fill material that is flowable (such as a clay, sand or the like. In other configurations, the body may be formed from a plurality of panels of metal or the like. It is likewise contemplated that the fill may include reinforced polymer construction, such as a resin matrix having fiberglass, carbon fiber or other reinforcement. In other configurations, a ceramic material (or a clay material) may form the fill material (and which may require subsequent processing for hardening) It is contemplated that a number of different material fillers may be utilized, and that the cavity may be divided into a number of different cavities each of which may be filled independently and with different material.

As set forth above, it will be understood that wall segments 10 which can be positioned below, above and side by side in relation to other wall segments 10 within trench 120 may be of different size and dimensioning.

Figure 8:
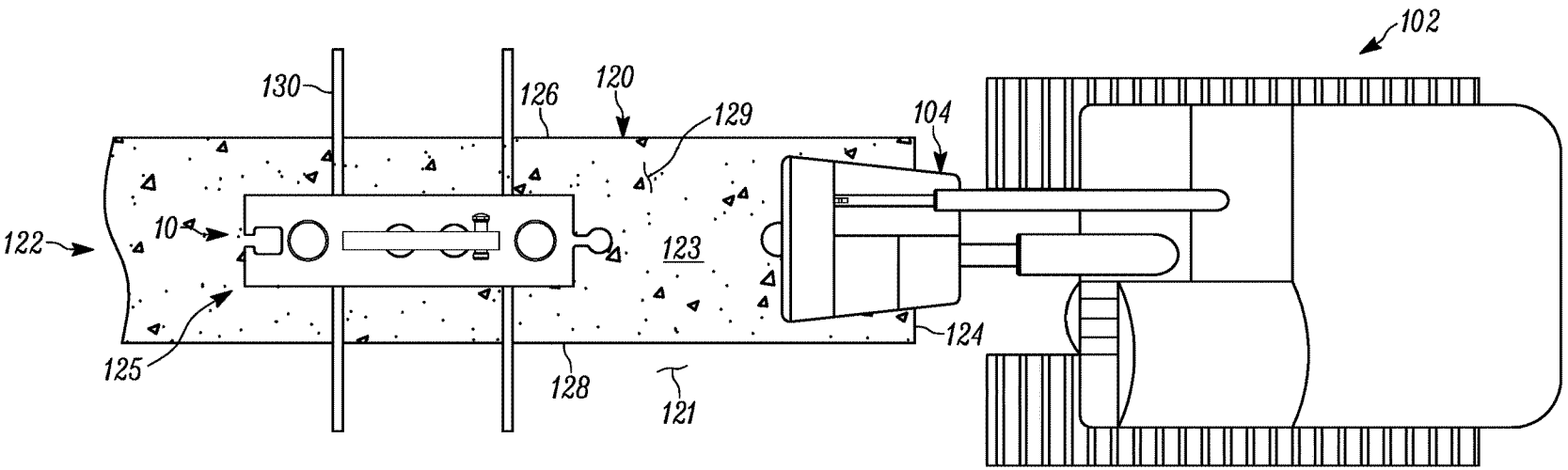
FIG. 8 of the drawings is a top plan view of a schematic representation of the channel preparation and placement of a wall segment.

Before construction of wall segments begins, a trench 120 must be prepared as show in FIG. 8. A trencher 102 uses a boom assembly 104 to prepare a trench 120. Trench 120 is defined with a first end 122, second end 124, first side 126, second side 128, trench bottom 123, top surface 121, and trench cavity 129. The trench cavity 129 is the void of space existing between first end 122, second end 124, first side 126, and second side 128 and extends the vertical distance of the top surface 121 and trench bottom 123.

The trencher 102 prepares a trench 102 using the trench boom 104 until such distance that the trench bottom 123 is reached. This distance in height is variable and dependent upon the desired height and length of the barrier wall 100. During construction of the barrier wall 100, a slurry material 125 will fill the trench cavity 129 to prevent collapse of trench walls. This slurry 125 material consists of sufficiently thick material to maintain integrity of the trench 120 dimensions during construction of the barrier wall 100. The amount of slurry 125 material is variable and dependent upon the desired height and length of the trench 120. The slurry 125 can be displaced during the entry and positioning of wall segments 10 and the water injection via the inlet member 89.

Figure 11:
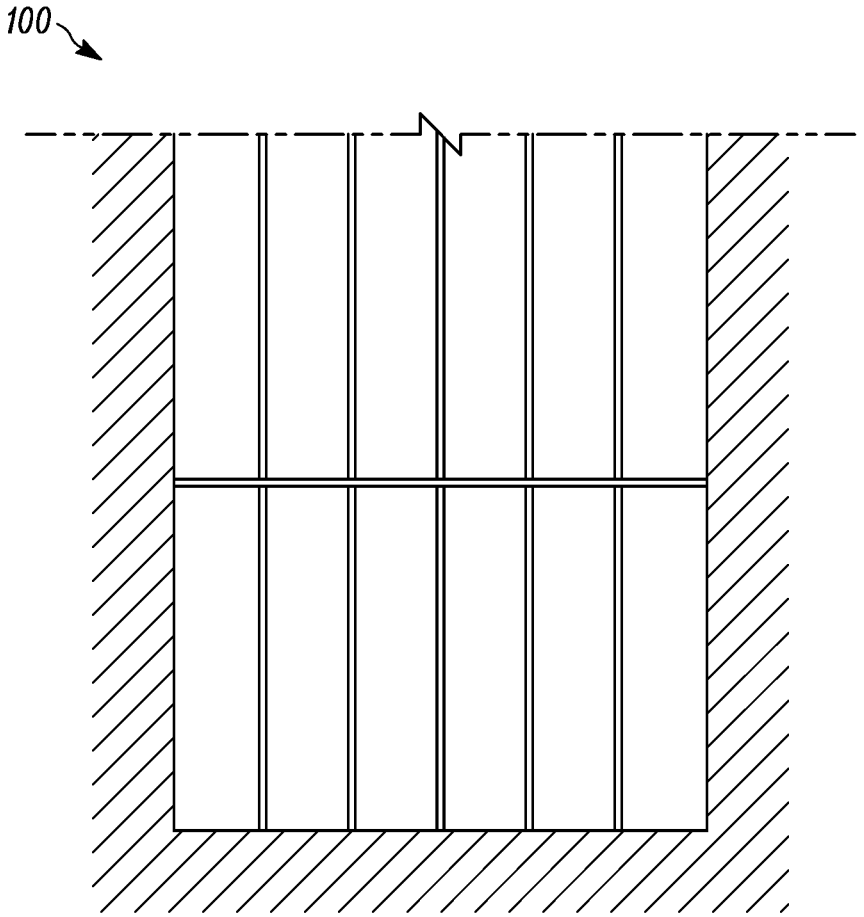
FIG. 11 of the drawings is a side elevational view of a schematic representation of the barrier wall assembled through a plurality of wall segments.

Following the trench fill of slurry 125 material, the first wall segment 10 is prepared by attaching the protrusions of the length couplings to, for example, a crane such as crane 105 (FIG. 11), to allow vertical lift to the wall segment 10 (of course other structures could likewise be formed for attachment of the crane thereto). The crane may also support a hose that can be attached to the inlet member 89 that will direct water or other fluids to flow through the wall segment 10 during placement. Once attached to the crane, the wall segment 10 is lowered into the trench cavity 129 via the crane. This will displace the slurry 125 material. The lowering of the wall segment 10 by the crane is done in parallel with water like or other displacing liquids through the inlet member 87. In some configurations, it may be unnecessary to direct water or another fluid through the manifold.

Figure 9:
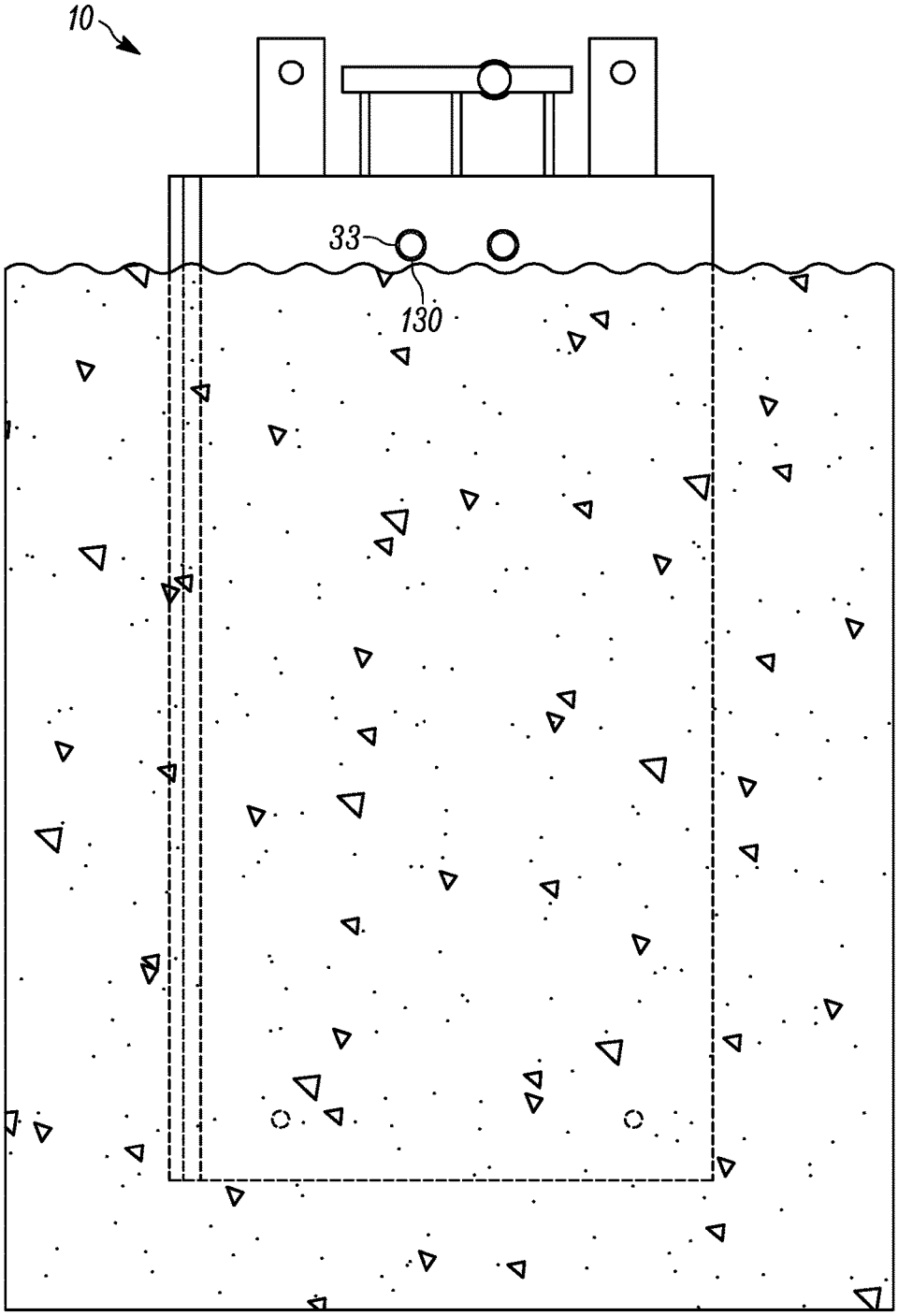
FIG. 9 of the drawings is a side elevational view of a schematic representation of a wall segment placed within a trench and supported by the interaction with the position restraining members.
Figure 10:
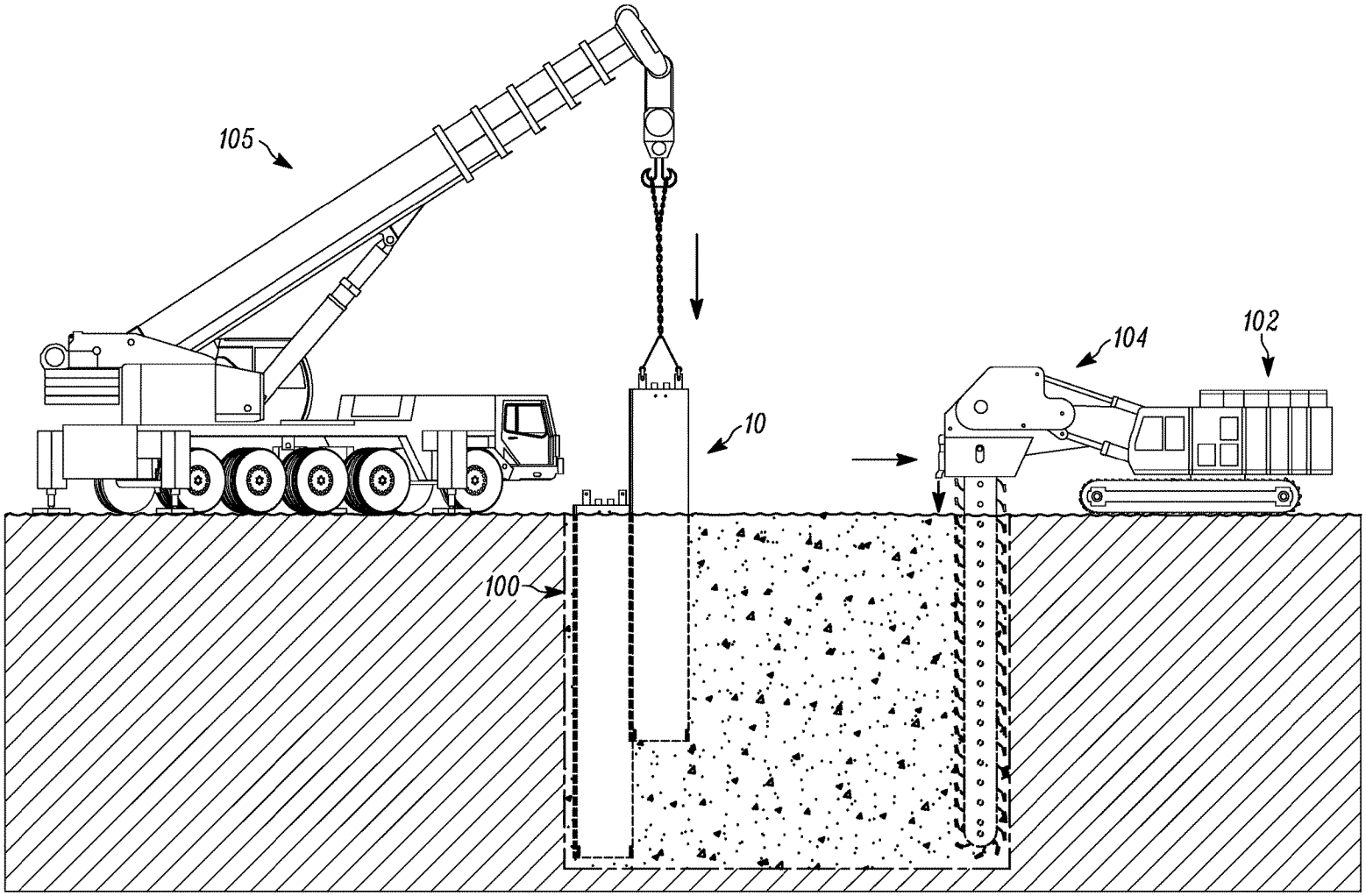
FIG. 10 of the drawings is a side elevational view of a schematic representation of the construction of a barrier wall assembly process.

As illustrated in FIG. 9, when the wall segment 10 reaches a significant insertion into the trench, position restraining members 130 are placed through the wall body 12 receiving openings 33. The position restraining members 130 are longer than the distance between the first side 126 and second side 128 of the trench 120. They are also made of a sufficiently strong material to support the wall segment as it sits within the trench without contact with the trench bottom 123. When the position restraining members 130 are in contact with the top surface 121 of the trench 120, the crane can be detached from the manifold 82 so the position restraining members 130 support the weight of the wall segment 10 within the slurry 125 material, essentially suspending the same.

As illustrated in FIG. 7, attachment of further wall segments 10 continues vertically along the previously placed wall segment 10 using the length coupling subassembly 14.

In particular, to vertically couple the subsequent wall segment to the inserted segment, the second wall segment is lifted by a crane and situated above the first wall segment. As it is lowered, the first protrusion 42 of the lower wall segment fits axially into the first channel 52 of the upper wall segment. The first channel 52 is sufficiently larger than the first protrusion 42 to allow entry. The first protrusion 42 is sufficiently long enough to reach inside the first channel 52 to allow an axial alignment between the first inner locking structure 47 and first outer locking structure 57. This alignment allows the first locking pin 60 to be inserted axially through the first inner locking structure 47 and first outer locking structure 57.

At the same time, the second protrusion 44 of the lower wall segment fits axially into the second channel 54 of the upper wall segment. The second channel 54 is sufficiently larger than the second protrusion 44 to allow entry. The second protrusion 44 is sufficiently long enough to reach inside the second channel 54 to allow an axial alignment between the second inner locking structure 49 and second outer locking structure 59. This alignment allows the second locking pin 62 to be inserted axially through the second inner locking structure 49 and second outer locking structure 59. Such a coupled structure is shown in FIG. 7.

It will be understood that the manifold (along with any hose coupled thereto) can be removed (i.e., through, for example, cutting of the first ends of the elongated tubes proximate the top surface of the wall body). With the positioning, the elongated tubes of subsequently coupled wall segments will align, maintaining the same in fluid communication. It is contemplated that the second end of the elongated tubes may have a slightly larger openings, and the elongated tubes at the first end can be cut at a predetermined location above the top panel. In such a configuration, the first end of the elongated tubes of a lower wall segment will insert into the slightly larger openings of the second end of the elongated tubes in a telescoping manner, to improve the communication therebetween.

The crane is next attached to the protrusions of the coupling member of the second and following wall segment 10 and lifts it to be positioned vertically over the wall segment 10 currently secured and maintained in position by the position restraining members 130. With assistance, the crane attached wall segment 10 is lowered until the top surface 24 of the position restraining member 130 supported wall segment 10 is mated with the bottom surface 26 of the crane-supported wall segment 10. Once mated, first locking pin 60 and second locking pin 62 are placed through the first inner locking structure 47, first outer locking structure 57, second inner locking structure 49, and second outer locking structure 59. The first locking pin 60 and second locking pin 62 will secure the inferior wall segment 10 and superior wall segment 10 together.

The secured wall segments may then be lifted up by the crane to allow the position restraining members 130 to be removed from the lower wall segment 10 to allow it to be placed further into the slurry 125 of the trench cavity 129. Each successive wall segment is maintained in position with the use of the position retaining members so that the subsequent wall segment can be attached thereto. It will be understood that in a similar manner, further vertical assembly of consecutive wall segments 10 continues until such time that the lower wall segment 10 is reaches the trench bottom 123, or until a desired height of the wall segments is reached.

As illustrated in FIG. 6, Assembly of the barrier wall 100 continues with horizontal assembly through the width coupling subassembly 16. The new wall segment 10 to be placed directly on one side of the previously assembled vertical wall segments 10 must be done so that the tab structure 77 is fitted inside the slot structure 72 of the vertically assembled wall segment 10 or the slot structure 72 is fitted outside the tab structure 77 of the vertically assembled wall segment 10. This forces a mate between the tab side surface 28 and slot side surface 29.

The first adjacent wall segment 10 is then lowered in sliding engagement. Once substantially inserted, position restraining members 130 reinserted through the receiving openings 33 to maintain the orientation relative to the trench, and not to further be directed into the trench, as set forth above. Vertical assembly of additional wall segments 10 continues as previously described with the new wall segments 10.

The assembly of vertical and horizontal wall segments 10 continues to meet the required length and width of the barrier wall 100 required. Further expansion of the trench 120 is performed by the boom 104 of the trencher 102. Slurry 125 material is further inserted into the trench 120 as it is expanded to prevent collapse of the first end 122, second end 124, first side 126, and second side 128. The trench bottom 123 may also have variable depth as is required for the barrier wall 100 assembly. Slurry 125 displaced during the assembly of the barrier wall 100 will likely flow over the top surface 121 off the trench 120. Removal of the slurry 125 as it is displaced is needed, but not required for construction of the barrier wall 100. It will be understood that the trench can be formed and lengthened during the insertion of wall segments. This substantially simultaneous, or simultaneous trenching and wall segment insertion can very expeditiously form a barrier wall.

Upon such time, up to and preceding the barrier wall 100 completion, sensors and other communication devices may be inserted into the assembled wall segments 10 to allow necessary measurements and data collection within the barrier wall 100. Insertion of said devices are through the elongated tubes 80 of the communication structures 18. Insertion of communication devices to wall segments 10 inferior in relation to the barrier wall is accomplished through elongated tubes 80 mated via the top surface 24 and bottom surface 26 of vertically assembled wall segments. For example, accelerometers may be inserted into the wall segments 10 of the barrier wall 100 to measure impact forces being applied to the walls segments 10. Additionally, listening devices and vibration sensors may likewise be provided.

Advantageously, the present system allows for the formation of a barrier wall of varying depth and length and allows for the placement of sensors therein. Additionally, the system allows for the simultaneous trench formation and barrier wall formation, such that both proceed at the same time, instead of first forming a full trench and then following up with the barrier wall. Additionally, the present system permits the formation of a barrier wall utilizing prefabricated components, such that there is no need to cure components inside the trench. Through prefabrication, sensors and other devices can be lowered and raised through the elongated tubes well after formation and throughout the life of the structure. Furthermore, whereas it may be difficult to control the curing and the structure deep within the trench, by inserting and coupling prefabricated portions, the overall barrier wall construction remains well defined and the structure within the trench is both uniform and known. These are but a few of the advantages of the system of the present disclosure.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A barrier wall configured for formation and placement within a formed trench, the barrier wall formed from a plurality of wall segments, each wall segment comprising:

a wall body including a front surface, a back surface, and an outer frame with a filler positioned therewithin, the outer frame further including a top surface, a bottom surface opposite the top surface, a tab side surface extending between the top surface and the bottom surface and a slot side surface extending between the top surface and the bottom surface opposite the tab side surface, to, in turn, define a rectangular cubic configuration, the filler comprising a concrete material;

a length coupling subassembly coupled to the wall body;

a width coupling subassembly coupled to the wall body, a plurality of inner braces embedded within the filler, to, reinforce the same, and a communication structure extending between the top surface and the bottom surface, the communication structure comprising a plurality of elongated tubes extending between the top surface and the bottom surface and further includes a manifold coupling a first end of a plurality of the plurality of elongated tubes, and an inlet providing ingress into the manifold;

wherein, the plurality of wall segments can be attached to each other by joining at least one of the length coupling subassembly of one of the plurality of wall segments to another one of the plurality of wall segments, and the width coupling subassembly of one of the plurality of wall segments to another one of the plurality of wall segments.

2. A barrier wall configured for formation and placement within a formed trench, the barrier wall formed from a plurality of wall segments, each wall segment comprising:

a wall body including a front surface, a back surface, and an outer frame with a filler positioned therewithin, the outer frame further including a top surface, a bottom surface opposite the top surface, a tab side surface extending between the top surface and the bottom surface and a slot side surface extending, between the top surface and the bottom surface opposite the tab side surface, to, in turn, define a rectangular cubic configuration, the filler comprising a concrete material;

a length coupling subassembly coupled to the wall body, the length coupling subassembly further comprising an upper coupling associated with the top surface and a lower coupling associated with the bottom surface, the upper coupling comprising a protrusion and the lower coupling comprises a channel, with the upper coupling and the lower coupling structurally configured to be positionable in engagement, the upper coupling further comprising a first protrusion and a second protrusion each having an inner locking structure, and the lower coupling comprises a first channel and a second channel each having an outer locking structure, wherein a locking pin can be interlaced between the inner locking structure and the outer locking structure of each of the lower and upper couplings positionable in engagement; and a width coupling subassembly coupled to the wall body, wherein, the plurality of wall segments can be attached to each other by joining at least one of the length coupling subassembly of one of the plurality of wall segments to another one of the plurality of wall segments and the width coupling subassembly of one of the plurality of wall segments to another one of the plurality of wall segments.

3. The barrier wall of claim 1, wherein the width coupling subassembly further comprises a first side width coupling member and a second side width coupling member, the first width coupling member extending along the slot side surface and the second width coupling member extending along the tab side surface.

4. The barrier wall of claim 3 wherein the first side width coupling member comprises a slot and the second side width coupling member comprises a tab, with the tab being slidably insertable within the slot.

5. The barrier wall of claim 4 wherein the tab is configured to be pivotable within the slot.

6. The barrier wall of claim 1 wherein the wall segment further comprises at least one receiving opening extending transversely through the wall body from the front surface to the back surface proximate an top end thereof, structurally configured to receive a position retaining member therein.

* * * * *